US005535926A

United States Patent [19]

Blitz et al.

[11] Patent Number: 5,535,926

[45] Date of Patent: Jul. 16, 1996

[54] APPARATUS FOR APPLYING MASTIC TO A SELECTED SURFACE

[75] Inventors: Eli Blitz, San Francisco; Mark Farnworth, Tracy, both of Calif.

[73] Assignee: Axia Incorporated, Oak Brook, Ill.

[21] Appl. No.: 271,131

[22] Filed: Jul. 6, 1994

[51] Int. Cl.[6] ..... B65D 88/54

[52] U.S. Cl. ..... 222/334; 222/385; 222/626; 417/553; 417/570

[58] Field of Search ..... 417/234, 384, 417/553, 570; 222/385, 334, 626

[56] References Cited

U.S. PATENT DOCUMENTS

| | | | |
|---|---|---|---|
| 4,105,490 | 8/1978 | Lass | 156/526 |
| 4,127,434 | 11/1978 | Lass | 156/526 |
| 5,137,386 | 8/1992 | Mower | 401/48 |

*Primary Examiner*—Andres Kashnikow
*Assistant Examiner*—Kenneth Bomberg
*Attorney, Agent, or Firm*—Laff, Whitesel, Conte & Saret, Ltd.

[57] ABSTRACT

An apparatus for applying mastic to a selected surface includes a container for mastic, a pump assembly, and a drywall tool or wand. The pump assembly is positioned in the container so that it draws mastic from the container and delivers it to the drywall tool. The mastic delivered to the drywall tool is applied to the selected surface through a nozzle in the drywall tool. The pump assembly includes a pump, a pneumatic cylinder, and a linking subassembly connecting the pump and the pneumatic cylinder. The pump assembly is operated by an air compressor. The air compressor causes a rod in the pneumatic cylinder to reciprocate. The linking subassembly translates this reciprocation to a piston in the pump assembly. The piston reciprocates within a bore of the pump assembly and draws the mastic from the container. The apparatus is mounted on a hand truck so that it may be moved to different locations.

13 Claims, 3 Drawing Sheets

APPARATUS FOR APPLYING MASTIC TO A SELECTED SURFACE

FIELD

This invention relates to tools used during the installation or repair of wall board, drywall, or other surfaces, and more particularly, to an apparatus for applying mastic to such surfaces.

BACKGROUND

The inventive tool is related to tools such as that shown and described in U.S. Pat. No. 4,105,490.

During the erection and installation of wall board, dry wall, ceilings, and other such surfaces, there are many reasons that joints, holes, or other irregularities appear on the surface of the wall board panel or between abutting edges of wall board panels. For example, these panels are usually 4 feet wide, are installed in edge-to-edge abutment, and held in place by nails or screws. The heads of the nails or screws are recessed into the wall board so that the nail or screw head will not show on the finished wall, and this leaves an irregularity in the wall board surface over each head. The gaps between abutting edges of wall board, as well as cracks, small holes, and sometimes, nicks or gouges caused by the workmen and their tools also create numerous irregularities on the surface of the wall boards.

Regardless of how these various surface discontinuities were formed, they must be filled with a suitable mastic (sometimes called "mud") to give a smooth, plaster-like surface. If the cracks or discontinuities are large enough, tape must be used along with the mastic to give a greater degree of mechanical strength to the surface.

There are various hand-held applicators for applying mastic to smooth the various discontinuities that form doing installation or repair of dry wall or wall board. Typically, the tools are loaded with mastic manually. For example, a mastic pump is inserted into a bucket containing the mastic, and a pump handle is repetitively and manually moved up and down by an operator to force mastic from an outlet on the pump into a reservoir in the drywall taping tool. This is a very tiring, cumbersome procedure for the operator. The manual pumping also loads the drywall tool unevenly, risking either spillage or underfilling. After this cumbersome procedure, the drywall taping tool can only be used until the reservoir is depleted, when it needs to be refilled by the same process again. This frequent interruption makes the job inefficient.

Previous attempts at automating this process of loading mastic into drywall taping tools have been impractical and unsatisfactory. For example, the system of U.S. Pat. No. 4,127,434 has a tank for holding the mastic which must be pressurized in order to function with the applicator. When the mastic tank is empty, it suffers from the same disadvantages as the prior art described previously, namely, that it must be refilled manually. In addition, the required pressurized tank is costly to manufacture, difficult to clean, and cumbersome for the operator to use.

Accordingly, there is a need for an apparatus for applying mastic to dry wall or other selected surfaces which permits the various applicators to be easily, efficiently and continuously supplied with mastic.

SUMMARY

Accordingly, an object of this invention is to provide a new and improved apparatus for applying mastic to selected surfaces.

Another object is to provide an apparatus which supplies drywall tools with mastic more efficiently.

According to the present invention, the foregoing and other objects and advantages are attained by an apparatus which includes a non-pressurized container for mastic and an associated pump. The pump has a pneumatically activatable piston which moves back and forth in the pump. The pump has valves so that when the piston moves back and forth, the mastic is drawn from the container through an inlet in the pump, then through a bore within the pump, and out of a pump outlet. From the pump outlet, the mastic flows into a receiving port in a wand. The wand has a nozzle connected to the receiving port. The mastic flows out of the nozzle and onto a selected surface.

According to another aspect of the invention, the piston is moved back and forth by a pneumatic cylinder. The pneumatic cylinder has a rod which is connected to the piston. The pneumatic cylinder is connected to an air compressor. When the air compressor is turned on, the rod moves back and forth, which causes the piston to move back and forth.

In accordance with still another aspect of the invention, the pump and the pneumatic cylinder are linked to each other by a linking subassembly. The linking subassembly has a rod connector for connecting the piston to the rod of the pneumatic cylinder. A tube enclosure surrounds the rod connector. One end of the tube enclosure is attached to the pump and the other end is attached to the pneumatic cylinder.

Still other objects, advantages, and novel aspects of the present invention will become apparent in the detailed description of the invention that follows, in which the preferred embodiment of the invention is shown by way of illustration of the best mode contemplated for carrying out the invention, and by reference to the attached drawing in which.

DESCRIPTION

Figure 1:
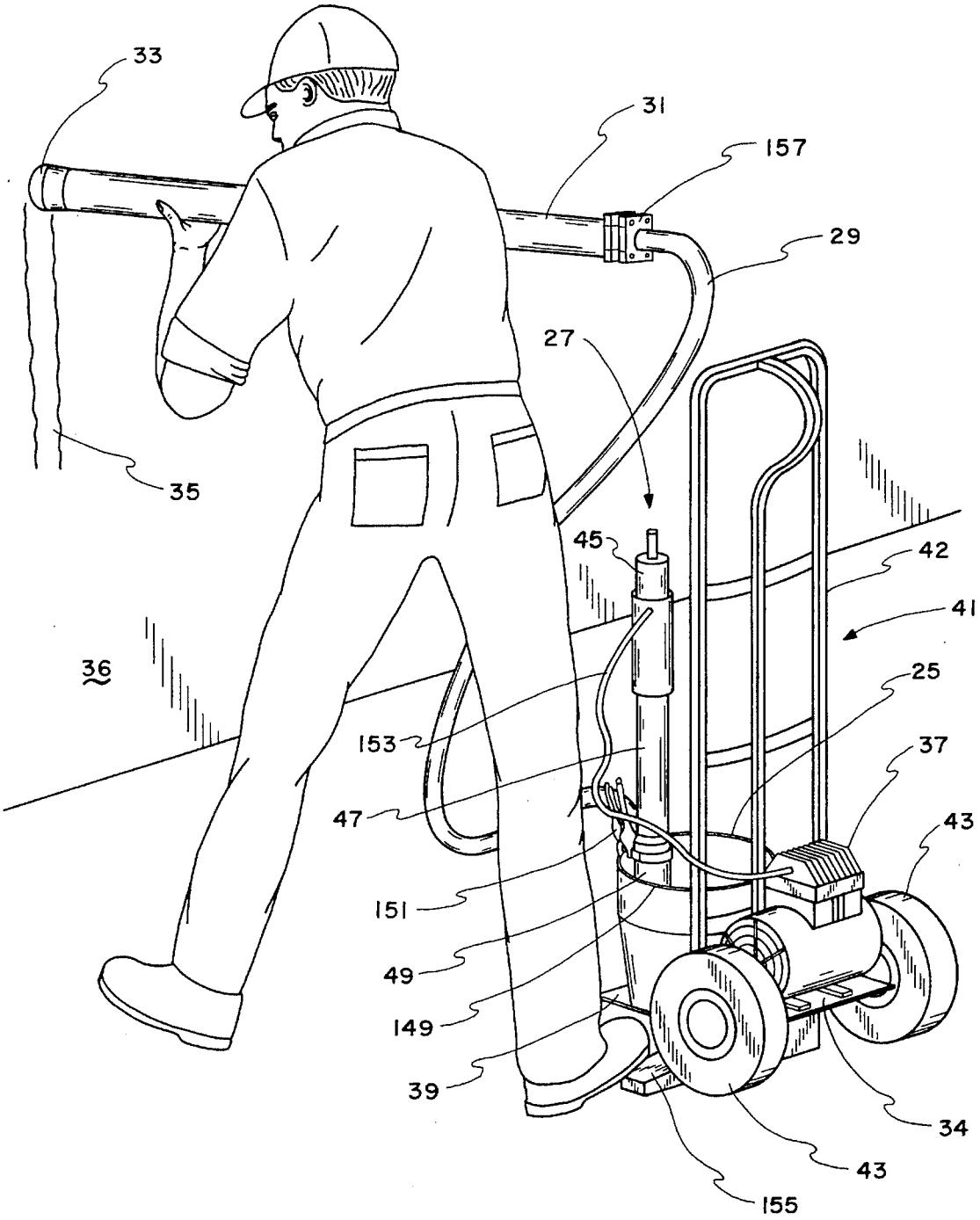
FIG. 1 is a perspective view of an apparatus for applying mastic incorporating the principles of the invention.

As shown in FIG. 1, an apparatus for applying mastic to a selected surface includes a non-pressurized container 25, in which the mastic is placed, and a pump assembly 27, which is positioned so that a portion of the pump assembly 27 extends into the container 25. The pump assembly 27 draws the mastic from the container 25 into a material hose 29 which is attached to the pump assembly 27.

The mastic travels through the material hose 29 by action of the pump assembly 27 and enters any of a variety of drywall tools, such as a drywall taping applicator or wand 31. The wand 31 includes a nozzle 33 from which the mastic exits to form an area of applied mastic 35 on a selected surface, in this case shown as dry wall 36.

The pump assembly 27 is activated to draw the mastic from the container 25 by pneumatic means, here shown as an air compressor 37. The air compressor 37 is electrically powered. The air compressor 37 and the container 25 are mounted to a base 39 of a hand truck 41. The hand truck 41 has a pair of wheels 43 mounted to opposing sides of the base 39 and a frame 42 so that the apparatus can be rolled by an operator to different locations.

Figure 2:
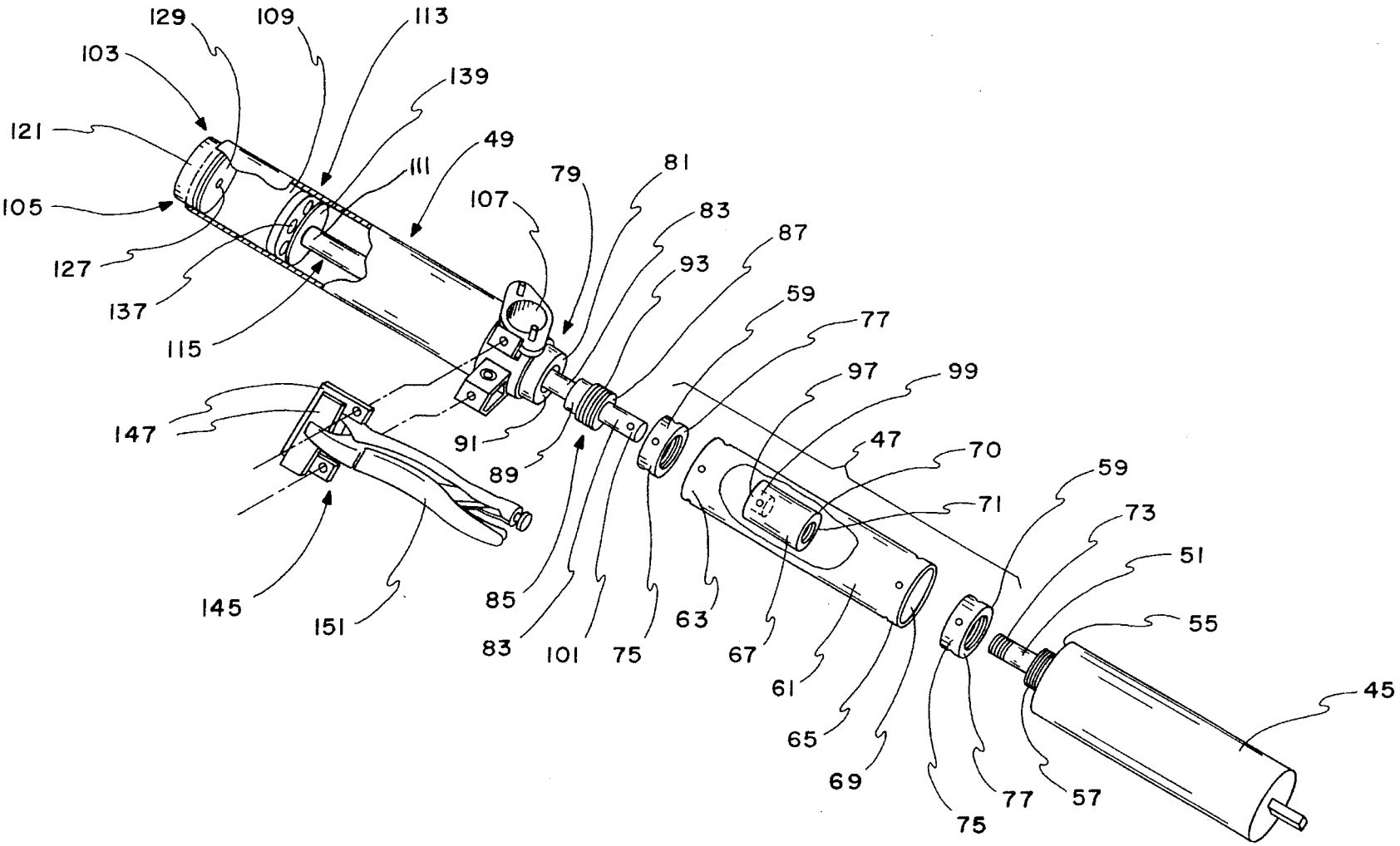
FIG. 2 is an exploded, perspective view of the pump assembly of the embodiment of FIG. 1.
Figure 3:
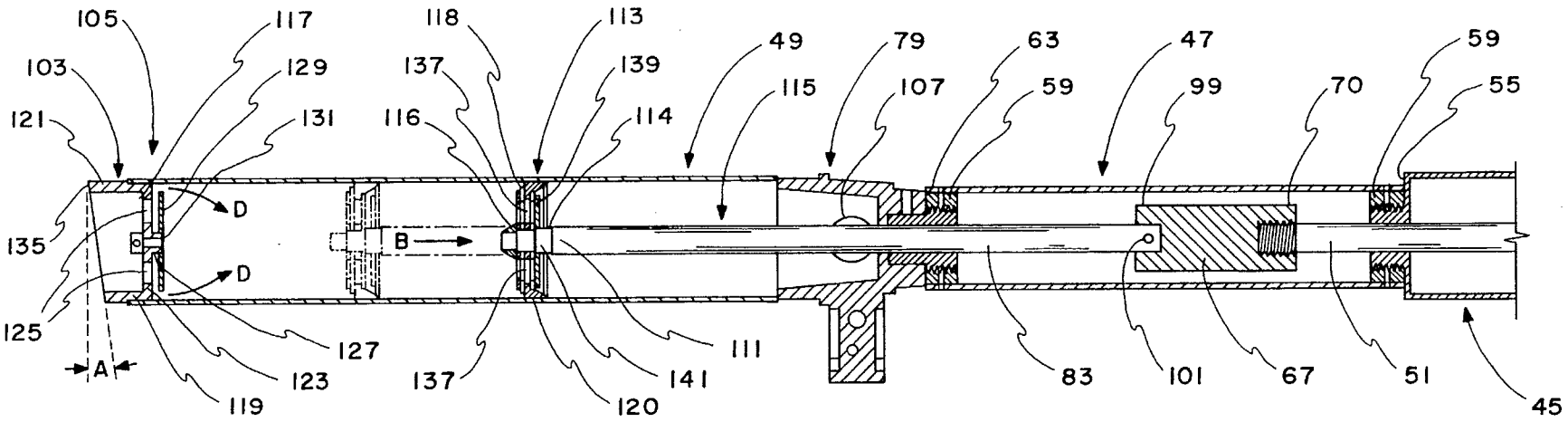
FIGS. 3 and 4 are sectional side views of a portion of the pump assembly shown in FIG. 2.
Figure 4:
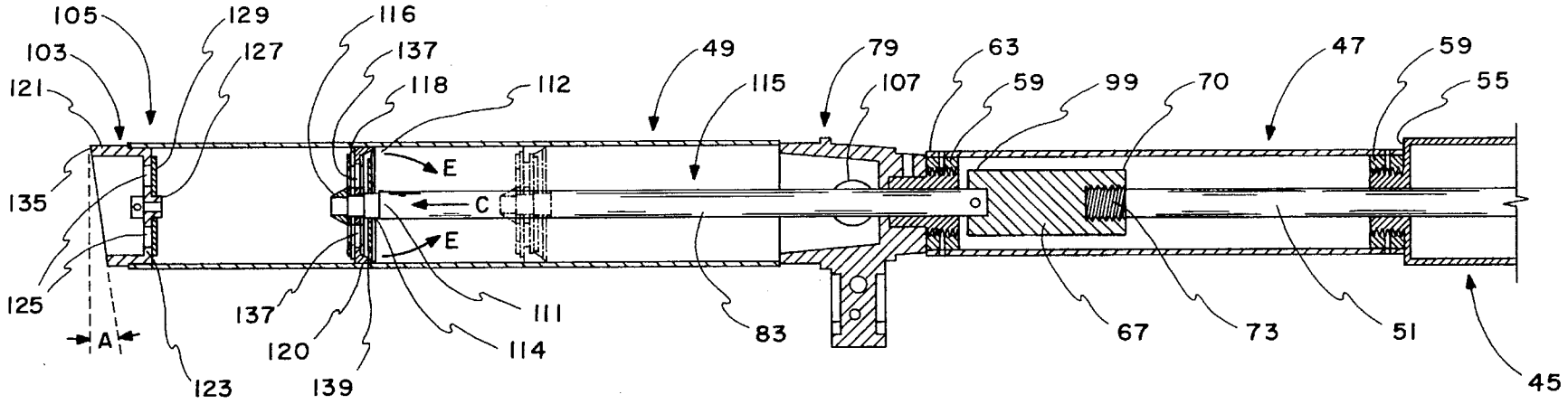

As shown in FIGS. 2–4, the pump assembly 27 includes a pneumatic cylinder 45 connected to a linking subassembly 47. The linking subassembly 47 in turn is connected to a pump 49. The pneumatic cylinder 45 has a reciprocating, cylinder rod 51 extending outward from the end 55 of the pneumatic cylinder 45. The end 55 includes a threaded portion 57 for connecting the pneumatic cylinder 45 to the linking subassembly 47 as described below. For the pneumatic cylinder 45, the automatic reciprocating cylinder Model VCR with bore size of 2.5 inches, from AllenAir, Fluid Power Products, of Mineola, N.Y. has been found suitable for this invention.

The linking subassembly 47 is generally cylindrical in shape and includes a tube enclosure 61 with opposing ends 63, 65. The tube enclosure has a longitudinal axis of symmetry and a bore 69 extending between the opposing ends 63, 65. A cylindrical rod connector 67 has a longitudinal axis of symmetry. The cylindrical rod 67 has a longitudinal axis of symmetry and is received within the bore 69 coaxially with the tube enclosure 61. The outer diameter of the rod connector 67 is less than the inner diameter of the bore 69 so that the rod connector 67 can reciprocate within the tube enclosure 61 without contacting the surface of the bore 69.

The rod connector 67 has a cylinder end 70. A threaded aperture 71 extends from the cylinder end 70 into the rod. The connector 67 and the aperture 71 are centered about the longitudinal axis of the rod connector 67. The aperture 71 is of sufficient size to threadably receive a threaded portion 73 of the reciprocating rod 51 of the pneumatic cylinder 45.

The subassembly 47 also includes mounting rings 59 with outer circumferences 75 of dimension appropriate to be received in the bore 69 of the tube enclosure 61. The mounting rings 59 are secured within the bore 69 at the opposing ends 63, 65 by conventional fastening means (not shown). The inner circumferences of the mounting rings 59 define threaded apertures 77. The threaded aperture 77 of one of the mounting rings 59 is sized to threadably receive the threaded portion 57 of the pneumatic cylinder 45.

The linking subassembly 47 is thus attached to the pneumatic cylinder 45. The end 65 of the linking subassembly 47 abuts the end 55 of the pneumatic cylinder 45, and the reciprocating rod 51 is connected to the rod connector 67 (FIGS. 3 & 4).

The attachment of the linking subassembly 47 to the pump 49 is now described with particular reference to FIGS. 2–4. The pump 49 includes an upper end 79 and a rod aperture 81 through the upper end 79. The pump has a piston 115 with a piston rod 83 which extends through and is slideably engaged in the rod aperture 81 at the upper end 79.

A gland 85 slideably receives the piston rod 83 through a gland aperture 87. The gland 85 has a resilient portion 89 which is sized to form an interference fit with the rod aperture 81. In addition, the resilient portion 89 is secured to sides 91 of the rod aperture 81 by any conventional fastening means. Adjoining the resilient portion 89 of the gland 85 is a threaded portion 93 which extends from the upper end 79 of the pump 49 toward the linking subassembly 47. The threaded aperture 77 of the mounting ring 59 at the end 63 is sized to threadably receive the threaded portion 93 of the gland 85.

The rod connector 67 has a rod end 97. An aperture 99 extends from the rod end 97 into the rod connector 67, and the aperture 99 is centered about the cylindrical axis of the rod connector 67. The aperture 99 is of sufficient size to receive the piston rod 83. The tip 101 of the piston rod 83 is secured in the aperture 97 by any suitable fastening means.

The linking subassembly 47 is thus attached to the pump 49 at the upper end 79 of the pump 49. The end 63 of the linking subassembly 47 abuts the upper end 79 of the pump 49 (FIGS. 3 and 4).

The reciprocating rod 51 of the pneumatic cylinder 45 is connected to the piston 115 of the pump 47 by means of the rod connector 67. Thus, when the reciprocating rod 51 is caused to reciprocate, the reciprocating motion of the rod 51 is translated through the rod connector 67 and causes the piston 115 of the pump to reciprocate as well.

The pump 49 is now further described with reference to FIGS. 2–4. The pump 49 is generally cylindrical in shape and has an inlet 103 at a lower end 105 and an outlet 107 at the upper end 79. The inlet 103 and the outlet 107 each communicate with an internal bore 109 which extends substantially over the length of the pump 49. The inlet 103, the bore 109, and the outlet 107 define a flowpath for the mastic drawn through the pump 49 as described below.

The piston head 113 has a plurality of circular retainer disks 118 and a circular piston cup 120 disposed coaxially between the circular retainer disks 118. The piston head 113 is connected to an end 111 of the piston rod 83 which extends longitudinally into the bore 109. The piston rod 83 is disposed parallel to the inner surfaces of the bore 109. The piston head 113 is mounted transversely to the piston rod 83 on the end 111 through an aperture 114 which extends through the piston head 113 and along its center axis. The end 111 protrudes beyond the piston head 113. A retaining ring 116 fits around the protruding portion of the end 111 to hold the piston head 113 on the piston rod 83.

The piston head 113 is sized so as to be slidable along the inner surface of the bore 109. Thus, when the piston rod 83 is reciprocated by action of the reciprocating rod 51, the piston head 113 reciprocates within the bore 109. The piston 115, the rod connector 67, and the reciprocating rod 51 are shown in FIG. 3 at the top of the stroke. The piston 115 at the top of the stroke has moved in the direction indicated by Arrow B within the bore 109 to the point closest to the outlet 107. Phantom lines indicate the position of the piston 115 at the bottom of its stroke.

Similarly, in FIG. 4, the piston 115, the rod connector 67, and the reciprocating rod 51 are shown at the bottom of the stroke. The piston 115 at the bottom of the stroke has moved in the direction indicated by Arrow C within the bore 109 to the point closest to the inlet 103. Phantom lines indicate the position of the piston 115 at the top of its stroke.

The inlet 103 includes a foot valve 117. The foot valve 117 has a generally circular base 123 extending across the bore 109, and a flange 119 extending perpendicularly from the perimeter of the base 123. The base 123 and the flange 119 are sized so as to form an interference fit with the bore 109 at the lower end 105 of the pump 49. The foot valve 117 thus can be removed from the lower end 105 of the pump 49 to ease cleaning of the bore 109 and the foot valve 117.

The flange 119 has a lower edge 121 which extends beyond the lower end 105 of the pump. The lower edge 121 is raked at an angle indicated by A so that the lower edge 121 is oblique in relation to the end 105 of the pump 49. The raked lower edge 121 thus includes a high point 135 which extends furthest from the end 105 of the pump 49. The raked lower edge 121 allows the mastic to enter the pump 49 when the end 105 is placed perpendicularly at the bottom of the container 25 (FIG. 1) containing the mastic, because only the high point 135 contacts the bottom of the container 25, thereby allowing the mastic to flow between the bottom of the container and the lower edge 121.

The base 123 has flow holes 125 extending through it. At the center of the base 123 is a post 127 which extends slightly toward the upper end 79 of the pump 49. A valve disk 129 is reciprocally mounted on the post 127 through an aperture 131 located in the center of the valve disk 129. The aperture 131 is of sufficient size to slideably receive the post 127. The valve disk 129 has a substantially flat circular shape and extends substantially across the base 123.

In the piston head 113, the retainer disks 118 have flow holes 137. A valve disk 139 overlies the retainer disks 118 between the retainer disks and the outlet 107. The valve disk 139 is reciprocally mounted on the end 111 of the piston rod 83 through an aperture 141 located in the center of the valve disk 139. The aperture 141 is of sufficient size to slideably receive the end 111. The valve disk 139 is a substantially flat circular shape and extends substantially across the retaining disks 118.

Referring to FIGS. 1 and 2, the pump includes a clamp 145 mounted adjacent the outlet 107. The clamp 145 has a pair of opposing jaws 147. The jaws 147 are inserted around either side of edge 149 of the container 25 (FIG. 1). The jaws are tightened around the edge 149 by gripping means, here shown as a vise grip 151. The clamp 145 secures the pump assembly 27 to the container 25.

As seen in FIG. 1, the air compressor 37 is pneumatically connected to the pneumatic cylinder 45 by an air feed tube 153. The air compressor 37 is selectively activated by an electric foot-pedal switch 155 which turns the air compressor 37 on or off.

The operation of the apparatus set out below is apparent from the foregoing description of the invention. The mastic is loaded into the container 25. The pump assembly 27 is operatively connected to the container 25 so that the inlet 103 is in contact with the mastic. When the operator depresses the foot-pedal 155 to switch on the air compressor 37, the pneumatic cylinder 45 is activated, and the reciprocating rod 51 reciprocates. The piston 115 connected to the reciprocating rod 51 also reciprocates in the bore 109 of the pump. When the piston 115 moves in the direction of the Arrow B as seen in FIG. 3, the valve disk 139 slides against the retainer disks 118 and overlies and seals the flow holes 137 in the piston head 113. The vacuum created at the lower end 105 causes the valve disk 129 at the foot valve 117 to slide up the post 127 away from the base 123. The vacuum draws the mastic present at the inlet 103 through the flow holes 125, around the valve disk 129, and into the bore 109 as indicated by Arrows D.

When the piston 115 moves in the direction of the Arrow C as seen in FIG. 4, the valve disk 139 slides away from the retainer disks 118 and uncovers and unseals the flow holes 137 in the piston head 113 to allow the mastic to flow through the piston head 113 in the direction indicated by arrows E. The pressure at the lower end 105 causes the valve disk 129 to slide down the post 127 against the base 123. The valve disk 129 overlies and seals the flow holes 125, thus preventing any mastic from flowing from the bore 129 back out the inlet 103. Repeated strokes of the piston 115 will draw the mastic through the inlet 103, through the bore 109, past the piston head 113, and out of the outlet 103.

From the outlet 103, the mastic is forced by the pump 49 through the material hose 29. The material hose 29 has one of its ends connected to the outlet 107 and the other of its ends connected to a receiving port 157 in the drywall tool 31. The material hose 29 is flexible to allow the tool 31 to be manipulated by the operator without disturbing the pump assembly 27. The mastic flows through the receiving port 157 into the drywall tool 31. From the tool 31, the mastic is applied to a selected surface, such as the drywall 36, by means of the nozzle 37.

Alternative embodiments of the present invention may replace the material hose 29 with any suitable means for delivering the mastic from the outlet 107 to the tool 31. For example, the receiving port 157 can be adapted to plug directly into the outlet 107. In still other alternatives, any of the numerous tools which apply mastic may be substituted for the tool 31.

In addition to the advantages apparent from the above description, the apparatus of the present invention allows drywall tools to be filled without the inefficient, tiring and energy-wasting manual pumping of the mastic into the tools.

Also, mastic can be continually supplied to the tools without the operator needing to put the tool down. Thus, the operator can apply the mastic to selected surfaces more efficiently. The invention supplies mastic at a selected, even flow, in contrast to the inconsistent flow which results from manual pumping.

As another advantage, mastic can be added to the container for delivery to the tool without the need to interrupt usage of the tool.

As still another advantage, the various assemblies and components of the apparatus are readily disassembled for easy cleaning.

While the present invention has been described with reference to a preferred embodiment thereof, illustrated in the accompanying drawings, various changes and modifications can be made by those skilled in the art without departing from the spirit and scope of the present invention; therefore, the appended claims are to be construed to cover equivalent structures.

What is claimed is:

1. An apparatus for applying mastic to a selected surface comprising:

a non-pressurized container for mastic;

a pump operably associated with the container, the pump having a piston reciprocally mounted therein;

pneumatic means for reciprocating the piston, the pneumatic means comprising a pneumatic cylinder having a reciprocating rod extending out from the cylinder and an air compressor having an air hose in pneumatic communication with the pneumatic cylinder to cause the reciprocating rod to reciprocate;

a linking subassembly comprising a rod connector having a rod end connected to the piston of the pump and a cylinder end connected to the reciprocating rod of the pneumatic cylinder, said linking subassembly further comprising a tube enclosure having opposing ends and a bore extending therethrough, one of the opposing ends connected to the pneumatic cylinder and the other opposing end connected to the pump, the rod connector being moveably received within the bore of the tube enclosure, whereby the reciprocating rod is operatively connected to the piston so that the piston reciprocates when the reciprocating rod is caused to reciprocate; and means for directing the mastic from the pump onto the selected surface.

2. The apparatus of claim 1, wherein the mastic directing means is a wand having a receiving port to receive the mastic from the pump, the wand having a nozzle in communication with the receiving port so that the mastic can flow out of the wand and onto the selected surface.

3. The apparatus of claim 1, wherein a foot-pedal switch is electrically connected to the air compressor to selectively activate the air compressor and the piston.

4. The apparatus of claim 1, wherein the linking assembly includes first and second mounting rings, the mounting rings connecting the pump and the pneumatic cylinder to the tube enclosure.

5. The apparatus of claim 4, wherein the mounting rings have inner and outer circumferences, the outer circumferences connected to the tube enclosure at the opposing ends of the tube enclosure, the inner circumference of the first mounting ring being connected to the pump and the inner circumference of the second mounting ring being connected to the pneumatic cylinder.

6. The apparatus of claim 1, wherein the tube enclosure and the rod connector have longitudinal axes of symmetry and the tube enclosure is coaxially aligned with the rod connector.

7. The apparatus of claim 1, wherein the piston includes a piston rod, the piston rod has an end extending out from the pump, and the rod connector has a first aperture in the rod end adapted to receive the end of the piston rod and a second aperture in the connector end adapted to receive the reciprocating rod.

8. The apparatus of claim 7, wherein the pump includes a gland, the gland having a gland aperture therethrough, the end of the piston rod slideably engaged in the gland aperture, the gland being connected to the tube enclosure.

9. The apparatus of claim 1 further comprising:

a hand truck having a base for supporting the container; and a hose having apertures at opposing ends and a passage extending through the hose and in communication with the apertures, one of the apertures communicating with the pump, another of the apertures communicating with the mastic directing means.

10. The apparatus of claim 9, wherein the hose is made of a flexible polymeric material.

11. The apparatus of claim 1, wherein the pump is connected to the container by a clamp with opposing jaws.

12. A pump assembly for delivering mastic from a mastic supply to an applicator tool comprising:

a pump having a bore and a piston reciprocally mounted in the bore;

a pneumatic cylinder having a cylinder rod extending out from the cylinder, the cylinder rod reciprocating when the cylinder is pneumatically activated;

a piston rod extending from the pump; and a linking subassembly connecting the cylinder rod and the piston, so that the piston reciprocates when the cylinder rod reciprocates, thereby drawing the mastic from the mastic supply and delivering the mastic to the tool, said linking subassembly further including:

a rod connector with a rod end connected to the piston rod and a cylinder end connected to the cylinder rod of the pneumatic cylinder; and a tube enclosure having opposing ends and a bore extending therebetween, one of the opposing ends connected to the pneumatic cylinder and the other opposing end connected to the pump, the rod connector being moveably received within the bore of the tube enclosure.

13. An apparatus for applying mastic to a selected surface comprising:

a hand truck having a base;

a non-pressurized container for mastic located on the base of the hand truck;

a pump assembly operably associated with the container, the pump assembly having a pneumatic cylinder and a pump, the pump having a bore and a piston reciprocally mounted in the bore, the pump having portions defining an inlet and an outlet through which the mastic can flow, the inlet and the outlet in communication with the bore of the pump, the inlet being located within the container so that the inlet is in contact with the mastic when the mastic is placed in the container, the pneumatic cylinder having a reciprocating rod extending out from the cylinder;

a linking subassembly connected to the pneumatic cylinder and the pump, the linking subassembly including a rod connector having a rod end connected to the piston of the pump and a cylinder end connected to the reciprocating rod of the pneumatic cylinder, said linking subassembly further including a tube enclosure having opposing ends and a bore extending therethrough, one of the opposing ends connected to the pneumatic cylinder and the other opposing end connected to the pump, the rod connector being moveably received within the bore of the tube enclosure;

an air compressor having an air hose in pneumatic communication with the pneumatic cylinder;

a foot-pedal switch electrically connected to the air compressor and mounted to the base of the hand truck to selectively activate the air compressor and the reciprocating rod;

a flexible hose having apertures at opposing ends, one of the apertures communicating with the outlet of the pump so that the mastic exiting from the outlet enters the flexible hose; and a wand having a receiving port in communication with another of the apertures of the hose to receive the mastic in the wand, the wand having a nozzle in communication with the receiving port so that the mastic can flow out of the wand and onto the selected surface.

* * * * *